US006055696A

United States Patent [19]

Lin

[11] Patent Number: 6,055,696

[45] Date of Patent: May 2, 2000

[54] SQUEEZING STRUCTURE FOR WATER-ABSORBENT SWAB

[76] Inventor: Pan-Chun Lin, P.O. Box 2103, Taichung, Taiwan

[21] Appl. No.: 09/384,969

[22] Filed: Aug. 30, 1999

[51] Int. Cl.[7] ..... A47L 13/144

[52] U.S. Cl. ..... 15/119.2

[58] Field of Search ..... 15/116.1, 116.2, 15/119.1, 119.2

[56] References Cited

U.S. PATENT DOCUMENTS 5,097,561 3/1992 Torres ..... 15/116.2
5,974,617 11/1999 Chang ..... 15/119.2

FOREIGN PATENT DOCUMENTS 0583434 10/1958 Italy ..... 15/119.2
994780 6/1965 United Kingdom ..... 15/119.2

*Primary Examiner*—Randall E. Chin

[57] ABSTRACT

A squeezing structure for water-absorbent swab, comprising a stem, a fixing seat, a roller shaft, a locating bar, a link, a pull handle and a foam rubber. The center of the roller shaft is disposed with an axially extending shaft rod. Multiple rollers are fitted around the shaft rod by stages. An outer circumference of the roller is formed with multiple axially extending and annularly arranged slipproof bodies. An end face of the roller and a lateral side of the roller contain an arch shoulder angle. The roller shafts with the stripes roll on the surface of the foam rubber so as to accurately squeeze and tension the foam rubber and effectively drain the water from the foam rubber. Furthermore, the arch shoulder angle of the end face of the roller tenderly contacts with the foam rubber without hooking or tearing the foam rubber.

4 Claims, 5 Drawing Sheets

SQUEEZING STRUCTURE FOR WATER-ABSORBENT SWAB

BACKGROUND OF THE INVENTION

The present invention relates to a squeezing structure for water-absorbent swab, and more particularly to a squeezing structure which is able to easily drain the water from the foam rubber of the swab and clean up the foam rubber.

FIGS. 1 and 2 show a conventional water-absorbent swab including a stem 11 and a fixing seat 12 disposed at a bottom end of the stem 11. Two rollers 13 are disposed on the fixing seat 12. A locating bar 14 is disposed between the two rollers 13. Two links 15 extend from top end of the locating bar 14 and pass through the fixing seat 12 to pivotally connect with a pull handle 16 of the stem 11. A water-absorbent foam rubber 17 is clamped between the bottom sides of the locating bar 14.

The roller 13 has a smooth surface so that when squeezing the foam rubber 17, the frictional force is insufficient. This will make it uneasy to push out the rollers 13 and cause a greater resistance. When forcedly pulling the pull handle 16 to lift the foam rubber 17, the smooth surface of the roller 13 will be unable to accurately grasp the surface of the foam rubber 17 and tension the foam rubber 17. Therefore, the squeezed part of the foam rubber 17 will resiliently slide and expand outward from the other side of the roller. Accordingly, the originally squeezed and drained water is again absorbed by the expanding part of the foam rubber 17 as shown in FIG. 2. Therefore, the water draining effect achieved by squeezing the foam rubber 17 is greatly reduced.

In addition, two ends of the roller 13 are formed with shoulder angles of right angles so that when squeezing the foam rubber 17, the right angles tend to exert a very great deforming force onto the foam rubber 17. Therefore, the foam rubber 17 is very likely to be cut apart.

SUMMARY OF THE INVENTION

It is therefore a primary object of the present invention to provide a squeezing structure for water-absorbent swab in which the rollers with stripes roll on the surface of the foam rubber so as to accurately squeeze and tension the foam rubber and thus effectively drain the water from the foam rubber.

The present invention can be best understood through the following description and accompanying drawings wherein:

DETAILED DESCRIPTION OF THE PREFERRED EMBODIMENTS

Figure 1:
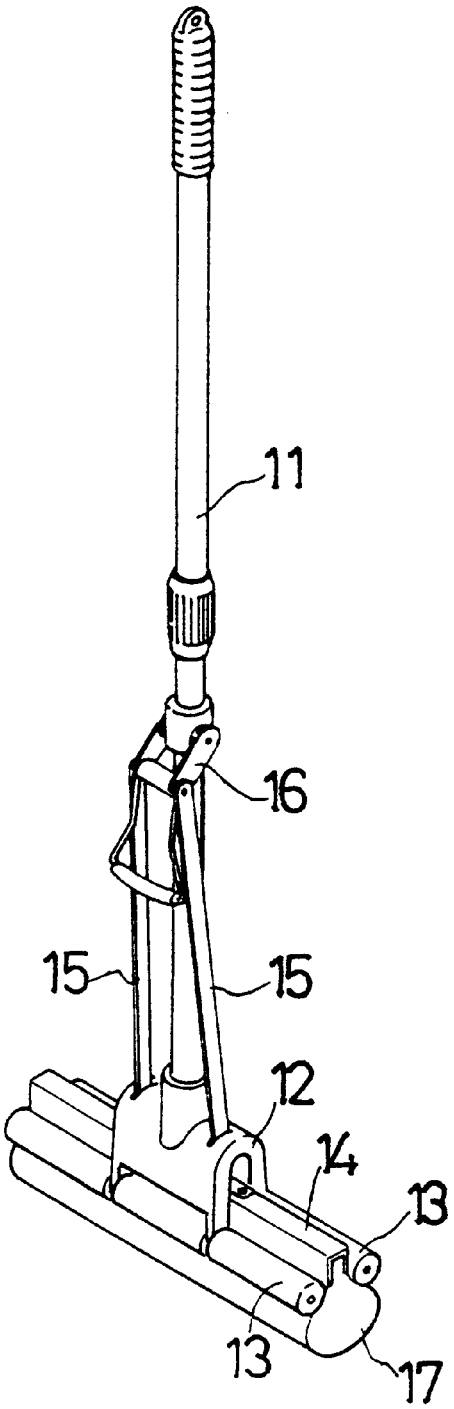
FIG. 1 PRIOR ART
FIG. 1 is a perspective assembled view of a conventional water-absorbent swab.
Figure 2:
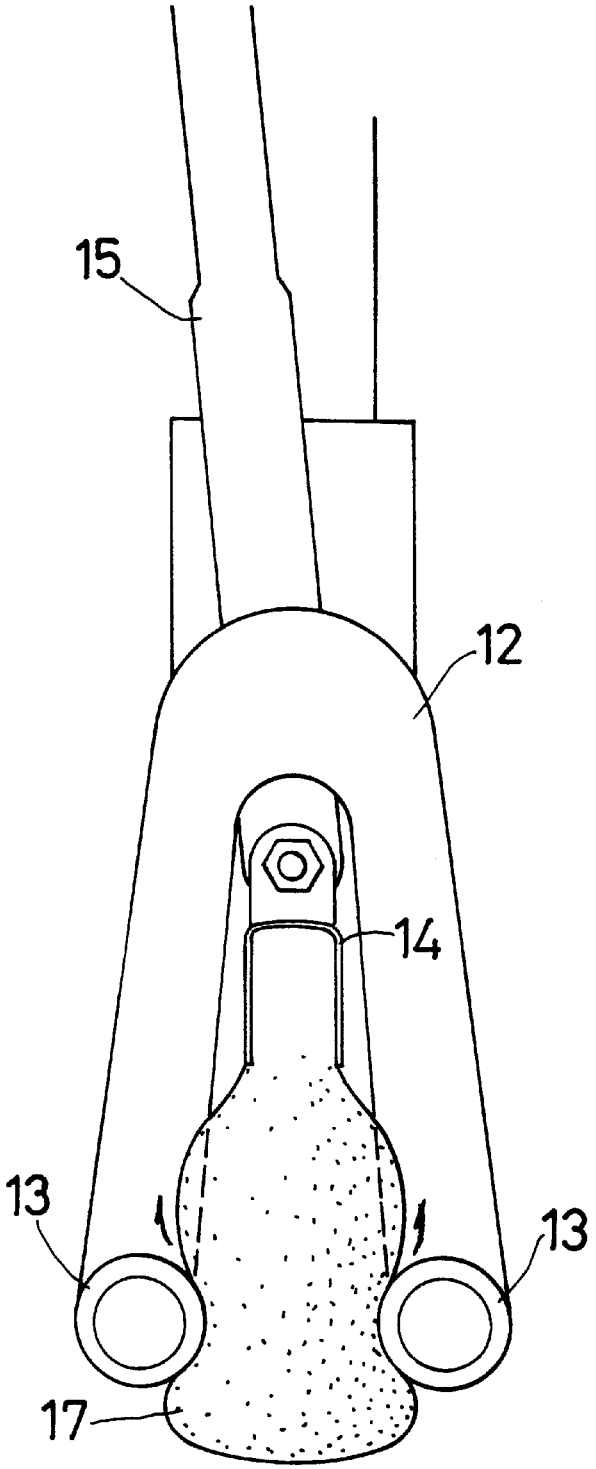
FIG. 2 PRIOR ART
FIG. 2 shows the use of the conventional water-absorbent swab.
Figure 3:
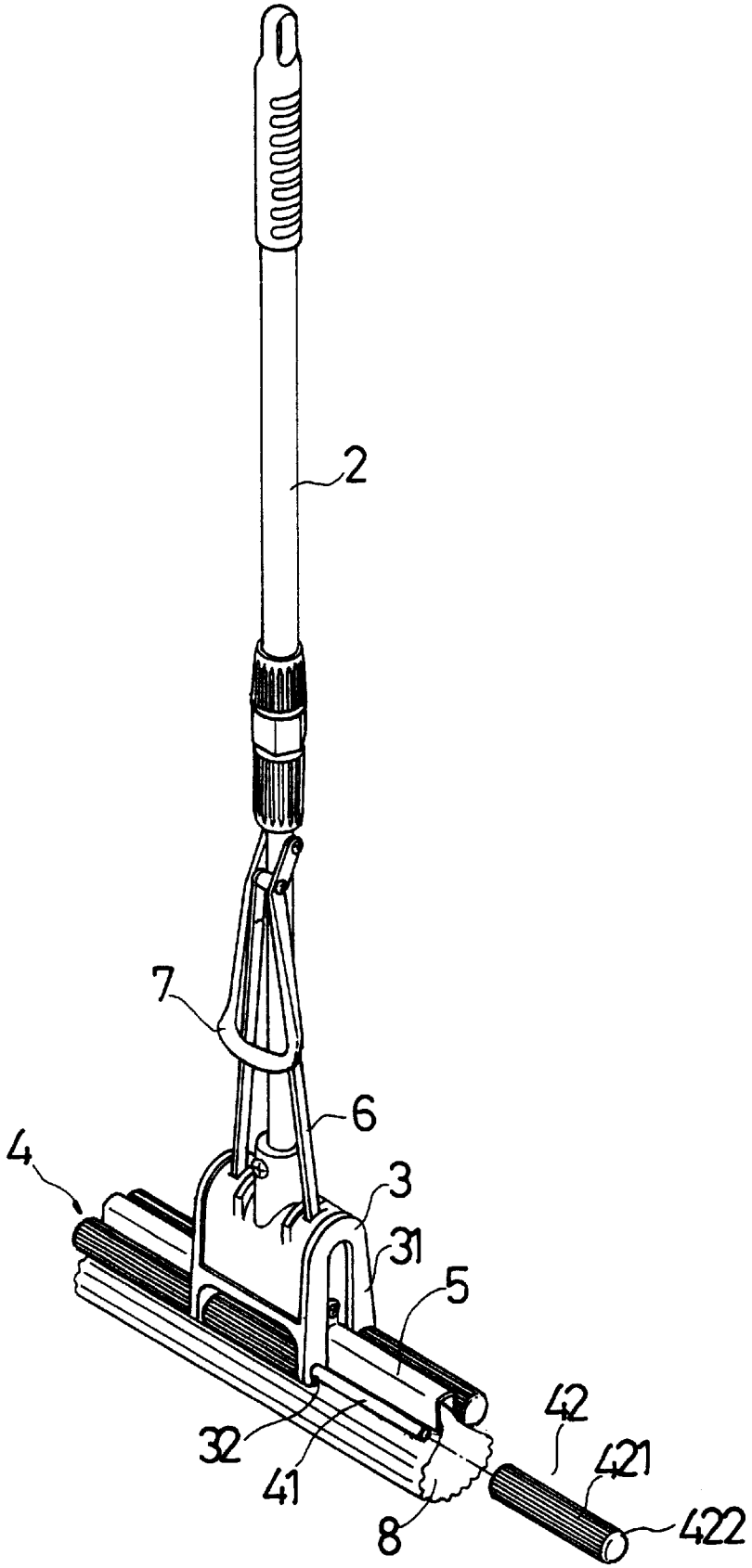
FIG. 3 is a perspective exploded view of the present invention.
Figure 5:
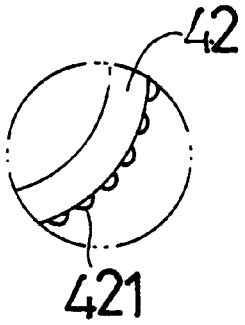
FIG. 5 is an enlarged view of area A of FIG. 4.
Figure 4:
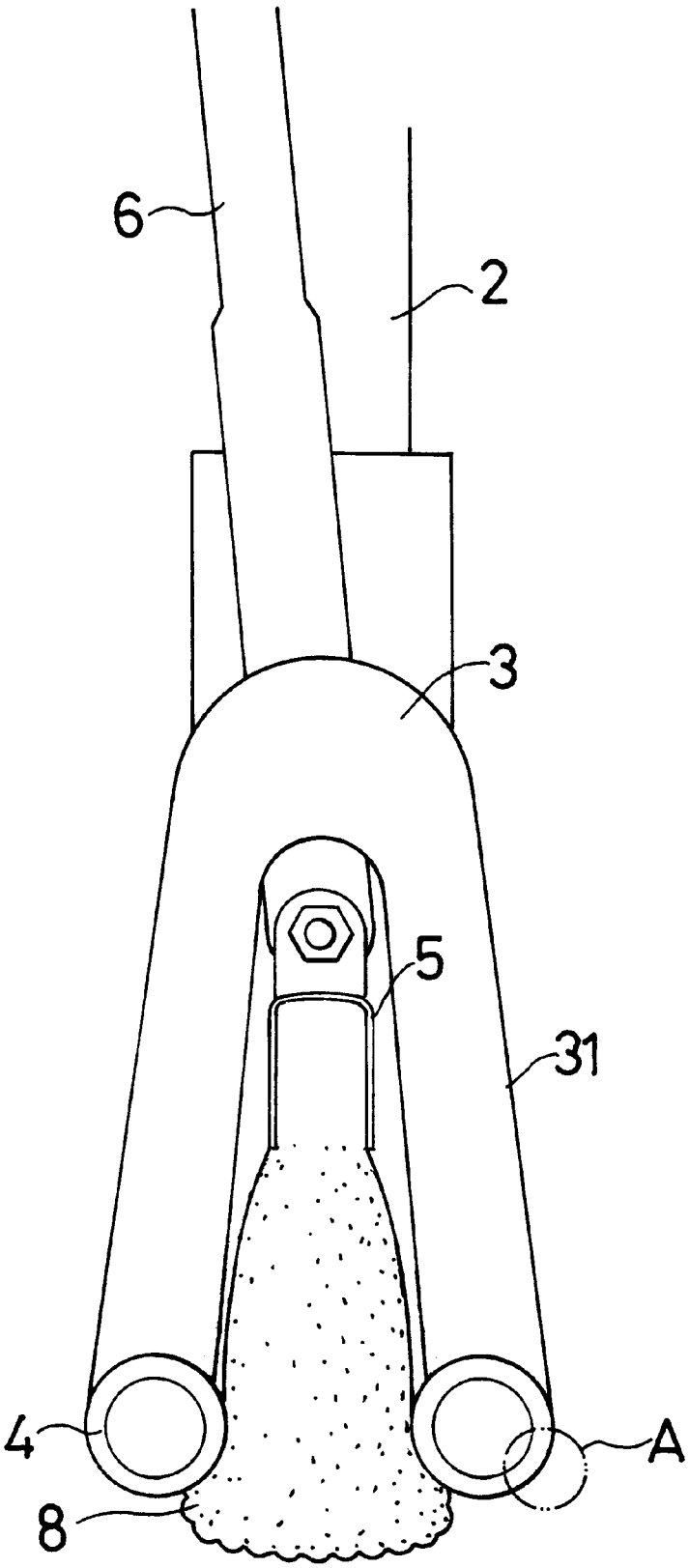
FIG. 4 shows the use of the present invention.

Please refer to FIGS. 3 to 5. According to a preferred embodiment of the present invention, the squeezing structure for the water-absorbent swab of the present invention includes a stem 2, a fixing seat 3, a roller shaft 4, a locating bar 5, a link 6, a pull handle 7 and a foam rubber 8. The stem 2 is a straight rod. The fixing seat 3 is disposed at the bottom end of the stem 2. The bottom of the fixing seat 3 is formed with two fork sections 31 each of which is formed with two transverse pivot holes 32. The roller shaft 4 is rotatably disposed in the pivot holes 32 of the same fork section 31. The center of the roller shaft 4 is disposed with an axially extending shaft rod 41. Three rollers 42 are fitted around the shaft rod 41 by stages. The roller 42 is a cylindrical body. The outer circumference of the roller 42 is formed with multiple axially extending and annularly arranged stripes 421. In addition, the end face of the roller 42 and the lateral side of the roller 42 contain an arch shoulder angle 422. The locating bar 5 is disposed between the two roller shafts 4. The top end of the locating bar 5 is disposed with two links 6 which pass through the fixing seat 3 to pivotally connect with the pull handle 7 of the stem 2. The foam rubber 8 is clamped between the bottom sides of the locating bar 5.

It should be noted that the stripes 421 of the roller 42 of the roller shaft 4 is able to accurately grasp the surface of the foam rubber 8 to achieve an actual rolling. Moreover, the arch shoulder angle 422 serves to tenderly touch the surface of the foam rubber 8.

Figure 6:
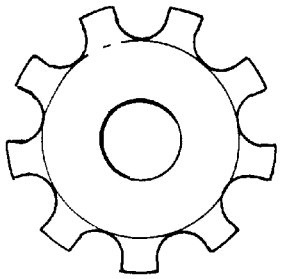
FIG. 6 is a side view of a second embodiment of the roller of the present invention, in which the surface of the roller is formed with dented stripes.
Figure 7:
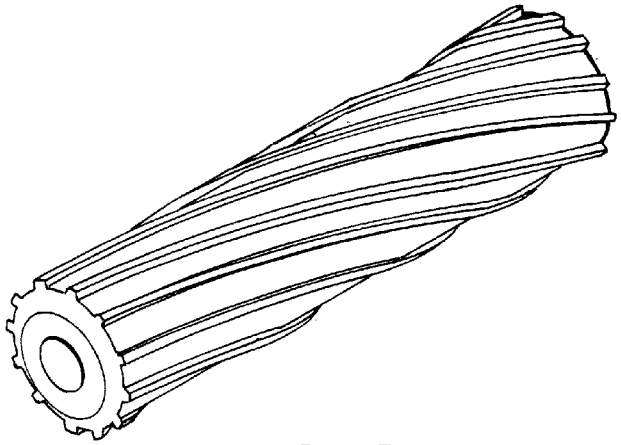
FIG. 7 is a perspective view of a third embodiment of the roller of the present invention, in which the surface of the roller is formed with spiral stripes.
Figure 8:
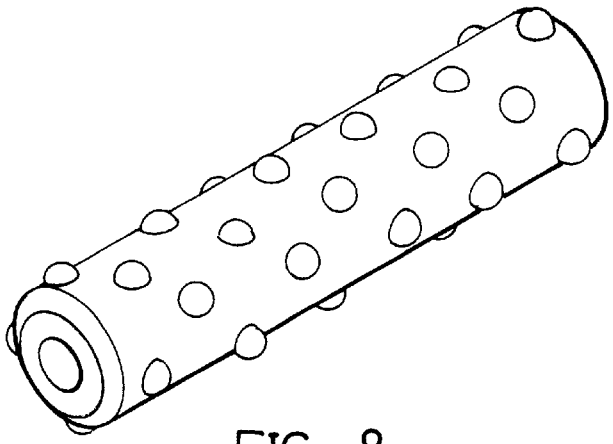
FIG. 8 is a perspective view of a fourth embodiment of the roller of the present invention, in which the roller is formed with a rough surface having multiple protuberances.

Referring to FIG. 4, in use of the present invention, the pull handle 7 is pulled upward to drive the links 6 for lifting the locating bar 5. At the same time, the foam rubber 8 is moved upward and squeezed by the roller shaft 4 disposed at the fork section 31. The stripes 421 of the roller 42 grasp the surface of the foam rubber 8 to roll. The top section of the foam rubber 8 is pulled upward, while the lower section of the foam rubber 8 is grasped by the roller 42 so that the foam rubber 8 is tensioned. Even the resilient restoring force of the squeezed foam rubber 8 cannot overcome the grasping force exerted onto the surface of the foam rubber 8 so that the foam rubber cannot slide and expand outward from the other side of the roller. Therefore, the roller shaft 4 of the present invention can accurately squeeze and tension the foam rubber 8 to effectively drain the water from the foam rubber 8. Furthermore, the arch shoulder angle 422 of the end face of the roller 42 tenderly contacts with the foam rubber 8 without hooking or tearing the foam rubber 8. Accordingly, the roller shaft 4 can smoothly roll. FIGS. 6, 7 and 8 show other aspects of the roller 42 which can achieve the same object.

The above embodiments are only used to illustrate the present invention, not intended to limit the scope thereof. Many modifications of the above embodiments can be made without departing from the spirit of the present invention.

What is claimed is:

1. A squeezing structure for water-absorbent swab, comprising a stem, a fixing seat, two roller shafts, a locating bar, a link, a pull handle and a foam rubber, the fixing seat being disposed at a bottom end of the stem, the two roller shafts being rotatably disposed on the fixing seat, the locating bar being disposed between the two roller shafts, the top end of the locating bar being disposed with two links which pass through the fixing seat to pivotally connect with the pull handle, the foam rubber being clamped between the bottom sides of the locating bar, said squeezing structure having the improvement in that the center of the roller shaft is disposed with an axially extending shaft rod, multiple rollers being fitted around the shaft rod by stages, an outer circumference of the rollers being formed with multiple axially extending and annularly arranged stripes, an end face of the rollers and a lateral side of the rollers containing an arch shoulder angle.

2. A squeezing structure for water-absorbent swab as claimed in claim 1, wherein the stripes of the rollers are dented stripes.

3. A squeezing structure for water-absorbent swab as claimed in claim 1, wherein the stripes of the rollers are spiral stripes.

4. A squeezing structure for water-absorbent swab, comprising a stem, a fixing seat, two roller shafts, a locating bar, a link, a pull handle and a foam rubber, the fixing seat being disposed at a bottom end of the stem, the two roller shafts being rotatably disposed on the fixing seat, the locating bar being disposed between the two roller shafts, the top end of the locating bar being disposed with two links which pass through the fixing seat to pivotally connect with the pull handle, the foam rubber being clamped between the bottom sides of the locating bar, said squeezing structure having the improvement in that the center of the roller shaft is disposed with an axially extending shaft rod, multiple rollers being fitted around the shaft rod by stages, an outer circumference of the rollers being formed with multiple axially extending and annularly arranged protuberances, an end face of the rollers and a lateral side of the rollers containing an arch shoulder angle.

* * * * *